US005735629A

United States Patent [19]

Sakamoto et al.

[11] Patent Number: 5,735,629

[45] Date of Patent: Apr. 7, 1998

[54] BAND CONNECTION FITTING

[75] Inventors: Hiroo Sakamoto; Toshihiro Takahashi, both of Tokyo, Japan

[73] Assignee: Seiko Kabushiki Kaisha, Tokyo, Japan

[21] Appl. No.: 655,118

[22] Filed: May 29, 1996

[30] Foreign Application Priority Data

May 31, 1995 [JP] Japan ..... 7-134587

[51] Int. Cl.[6] ..... F16B 21/06

[52] U.S. Cl. ..... 403/325; 403/407.1; 24/265 B; 24/656

[58] Field of Search ..... 403/325, 321, 403/326, 327, 405.1, 406.1, 407.1, 324; 24/325, 265 B, 648, 656, 69 J

[56] References Cited

U.S. PATENT DOCUMENTS

| | | | |
|---|---|---|---|
| 4,190,934 | 3/1980 | Wildi . | |
| 4,675,955 | 6/1987 | Nakamura | 24/656 |
| 5,191,685 | 3/1993 | Aoki et al. | 24/656 |
| 5,313,691 | 5/1994 | Yashimoto | 24/656 X |
| 5,412,850 | 5/1995 | Miranda | 24/656 X |
| 5,457,860 | 10/1995 | Miranda | 24/265 B X |

FOREIGN PATENT DOCUMENTS

| | | | |
|---|---|---|---|
| 0133068 A1 | 2/1985 | European Pat. Off. . | |
| 2344741 | 3/1974 | Germany | 24/265 B |
| 656512 | 6/1984 | Switzerland . | |
| 661609 | 11/1951 | United Kingdom . | |
| 861465 | 2/1961 | United Kingdom . | |
| 2231082 | 11/1990 | United Kingdom . | |
| 2 273 736 | 12/1993 | United Kingdom . | |

*Primary Examiner*—Harry C. Kim

*Attorney, Agent, or Firm*—Stroock & Stroock & Lavan LLP

[57] ABSTRACT

The present invention relates to a band connection fitting which, in order to connect a band, is provided with a connector which is arranged at one end of the band, and which has a spring bar which is provided with press buttons which are pressable from both sides of the band in a crosswise direction; and a receiving member which is arranged on the other end of the band, and which has claws which engage the press buttons when in the normal state, and which release the engagement when the press buttons are pressed inward from both sides of the band in a crosswise direction. The band connection fitting of the present invention operates easily and with certainty, and has high durability.

2 Claims, 3 Drawing Sheets

BAND CONNECTION FITTING

BACKGROUND OF THE INVENTION

1. Field of the Invention

The invention of the present application relates to a connection fitting for a band.

2. Description of the Related Art

As conventional band connection fittings, there are a connection fittings which have a hook formed on one end of a band which engages an engaging portion formed on the other end of the band, and a swinging leaf which is provided on an end of the band which swings and elastically catches one part of the band in such a way that the hook and the engaging portion do not separate; and there are connection fittings in which a metal connection is installed which is freely foldable at a middle section in between each end of the band, when wearing the band, the metal connection fitting is folded in the middle so as to run along itself in such a way that an engaging leaf formed in the end of one side of the metal connection fitting elastically engages the end of the other side.

However, the band connection fittings of the conventional art have a problem in that the hook connects with the engaging portion, or otherwise the swinging leaf swings so that the metal connection fitting is folded and the end portion engages engaging leaf, therefore, when applied to a watch band, a bracelet, or the like, it must be operated by one hand, and this is troublesome. In addition, there is also the problem that since the swinging leaf or the engaging leaf engage elastically in such a way that the connection does not become undone, there is the possibility that the engagement will disengage due to careless or unintentional external force. Furthermore, the engagement becomes imperfect due to metal fatigue resulting from repetitious engagement and wearing.

SUMMARY OF THE INVENTION

In view of the above problems, two of the objects of the present invention are:

(a) a band connection fitting which can be operated simply and with certainty, and (b) a band connection fitting which has high durability.

The band connection fitting of the present invention adopts a technique which provides a connector which is disposed on one end of the band in order that the band can be connected, and which has a spring bar provided with press buttons which are pressable from both sides of the band in a crosswise direction; and a receiving member arranged on the other end of the band which has claws which engage the press buttons when in the normal state, and which release the engagement when the buttons are pressed in from both sides of the band in a crosswise direction.

In this case, it is preferable that the connector and the receiving member connect in a freely folding manner.

In the band connection fitting of the present invention, when the connector and receiving member are pressed together, the connector and the receiving member are engaged by means of contraction and expansion of the spring bar.

On the other hand, with regard to releasing the above-mentioned engagement, pressing the press buttons in on both sides in a crosswise manner in such a way that the spring bar compressed, thereby releasing the engagement of the connector and the receiving member.

The band connection fitting according to the present invention provides the following results.

(1) It is possible to connect and release the connection using the expansion and contraction of the spring bar by means of the operation of the press buttons, and the connection of the band can be achieved easily and with certainty.

(2) Since it is possible to make the connection and release the connection by the compression of the spring bar by the operation of the press buttons, high durability can be achieved.

DESCRIPTION OF A PREFERRED EMBODIMENT

Figure 1:
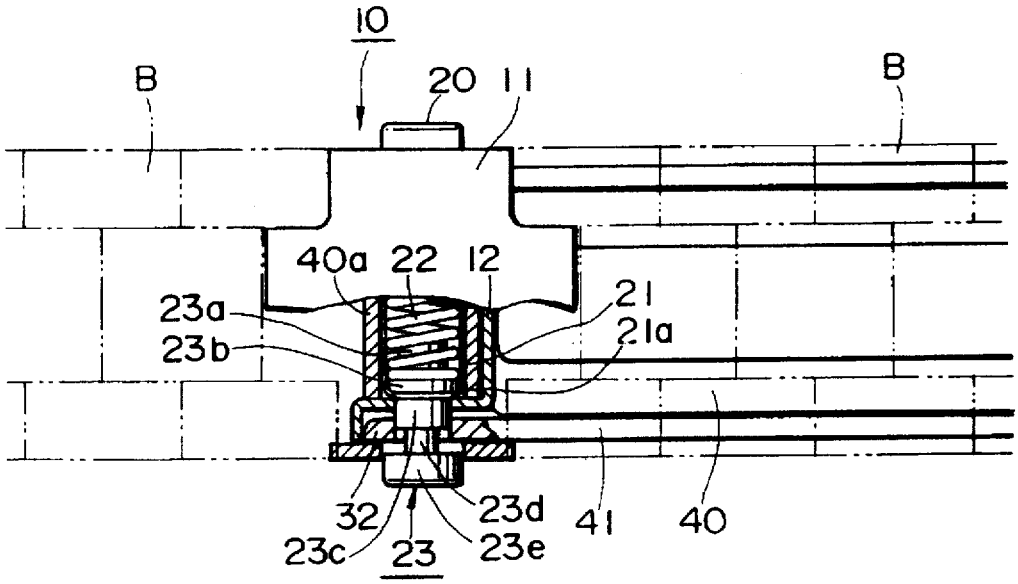
FIG. 1 shows a plan view of a cut away section of a preferred embodiment of a band connection fitting according to the present invention.
Figure 2:
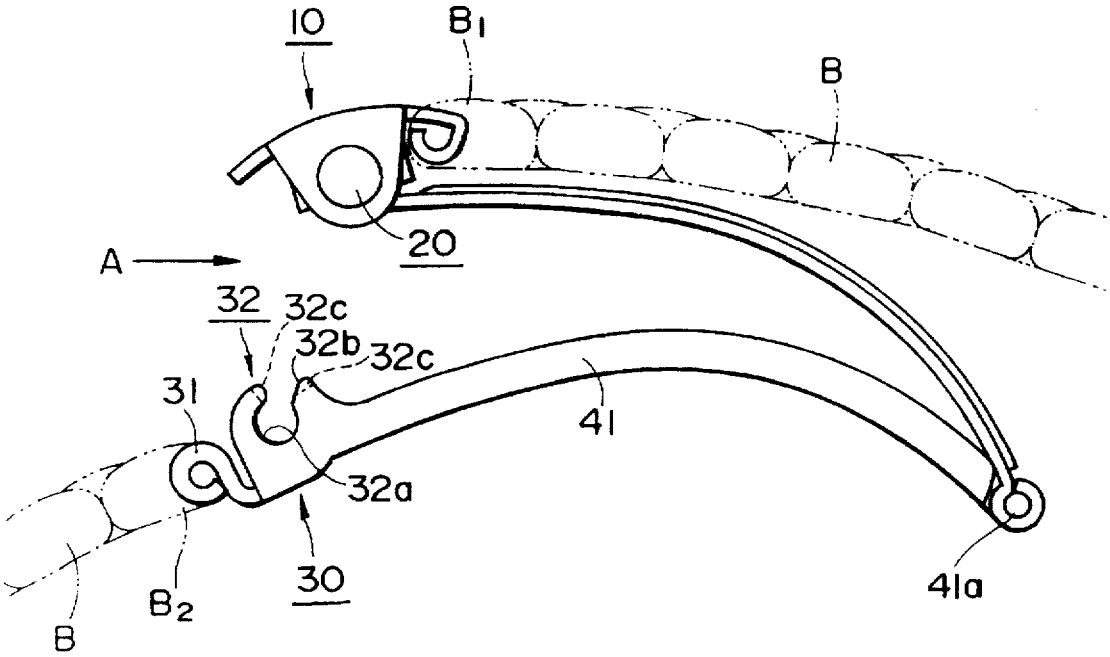
FIG. 2 is a front view of the band connection fitting shown in FIG. 1.

In the following, a preferred embodiment of the band connection fitting according to the present invention is explained with reference to the figures.

FIGS. 1 to 4 show a preferred embodiment of the band connection fitting according to the present invention. The connection fitting comprises a connector 10, a receiving member 30, a middle plate 40, and a lower plate 41, and is shown applied to a tri-fold metal type watch band.

The above-mentioned connector 10 comprises an upper cover 11, a restraining plate 12, and spring bar 20, and is fitted to one end B1 of the band B.

The above-mentioned upper cover 11 comprises a top plate 11*a* which extends between the ends B1, and B2 of the band B when the band is connected, and which has a high quality external appearance; side plates 11*b* which are formed from the sides of the top plate 11*a* in a downward direction; an attaching part 11*c* for attaching the upper cover 11 to the end B1 of the band, and which is formed on the backward side of top plate 11*a* in a longitudinal direction; and insertion apertures 11*d* which are formed in side plates 11*b* and through which press buttons 23*e*, mentioned below, are passed.

The above-mentioned restraining plate 12 is housed within the upper cover 11 and is formed with recesses 12*a* through which the spring bar 20 is inserted, and wall 12*b* surrounding recesses 12*a* limit the longitudinal movement of spring bar 20.

The above-mentioned spring bar 20 comprises casing 21 which is tubular and which has an edge portion 21*a* with a reduced diameter; a spring 22 which is arranged inside casing 21 along the axis of casing 21: and pressing members 23 which are disposed at both ends of spring 22.

The above-mentioned pressing member 23 comprises a rod 23*a* which is formed as a cylindrical shaft and has an outer diameter equal to the inner diameter of spring 22, and which prevents deflection of pressing member 23; a disc 23*b* which is unitarily formed with rod 23*a*, has an external diameter equal to the external diameter of spring 22, and which engages the end 21*a* of casing 21 and which prevents the spring 22 from breaking out of the casing 21 of pressing member 23; covering catch 23*c* which is unitarily formed with discs 23*b*, and which engages catch 32*b* of receiving member 30, explained below; passing section 23*d* which is smaller in diameter than covering catch 23*c*, passes through catch 32*b* of receiving member 30, explained below, and which is unitarily formed with covering catch 23*c*; and press button 23*e* which is arranged so that it is inserted through insertion apertures 11*d* of upper cover 11 and protrudes outward from side plates 11*b*, and which is unitarily formed with passing section 23*d*.

On the other side, the above-mentioned receiving member 30 can be connected to an end B2 of band B and comprises attaching part 31 which attaches to the end B2 of band B; and claws 32 which are arranged at a forward position of attaching part 31 on both widthwise ends.

The above-mentioned claws 32 comprise a receiving part 32*a* which is of a size which can receive the covering catch 23*c* of pressing member 23; and a catch 32*b* which is of a size which allows passing section 23*d* to pass through but which catches covering catch 23*c* of pressing member 23 and which is unitarily formed with receiving part 32*a*. Inclined portion 32*c* is formed on the inner surface of the forward edges.

The above-mentioned middle plate 40 is equipped with a tube 40*a* at one end through which spring bar 20 is inserted, and by inserting spring bar 20 through tube 40*a*, middle plate 40 is connected to connector 10.

The above-mentioned lower plate 41 is formed unitarily with receiving member 30, and is connected in a freely swinging manner with middle plate 40 by means of connecting part 41*a*; as a result, middle plate 40 and lower plate 41 connect connector 10 and receiving member 30 in a freely folding manner.

Procedure of assembly of the above-mentioned connector 10 is conducted according to the following.

Figure 3A:
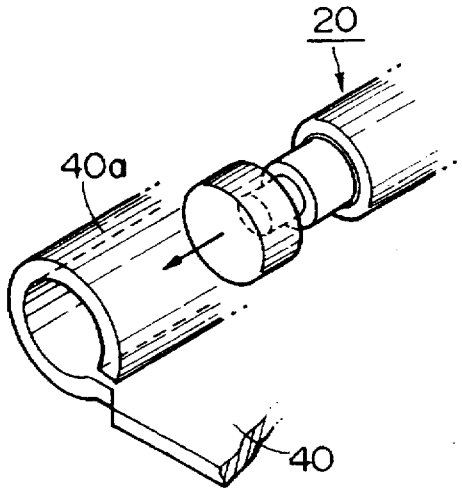
FIGS. 3A, 3B, 3C, and 3D are perspective views showing the procedure of assembly of the connection fitting according to FIG. 1.
Figure 3B:
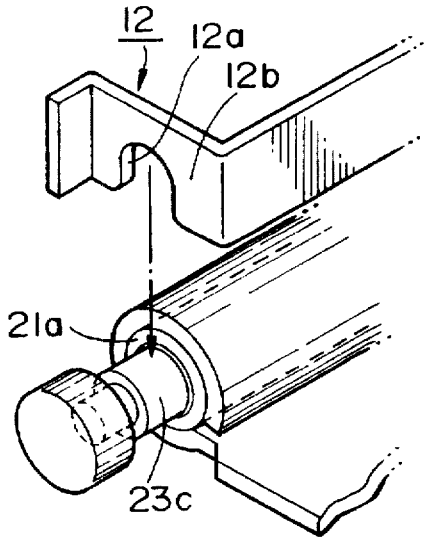
Figure 3C:
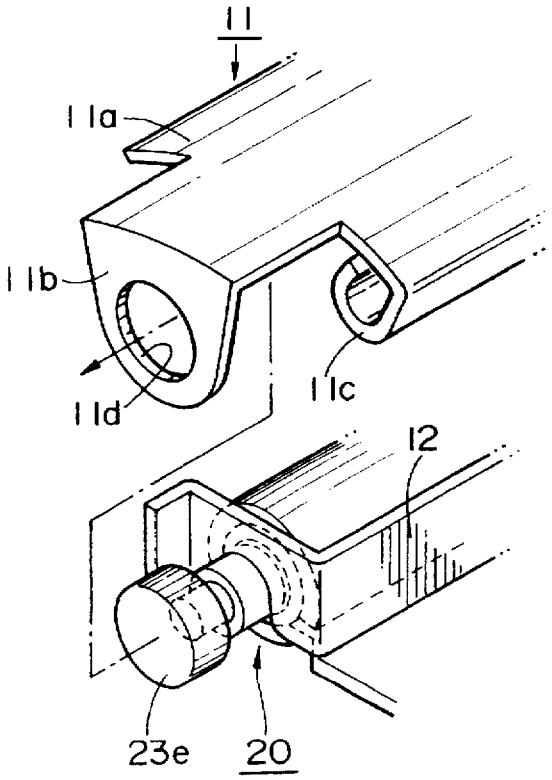
Figure 3D:
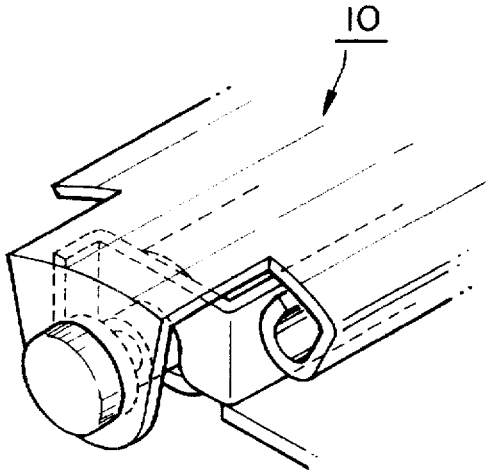

As shown in FIG. 3A, spring bar 20 is inserted through tube 40*a* of middle plate 40. Then, as shown in FIG. 3B, the covering catch of spring bar 20 is positioned in such a way that it fits into the recesses 12*a* of the restraining plate 12. Thereby, spring bar 20 is fixed and prevented from moving in a crosswize direction since the end 21*a* of casing 21 is retained by the walls 12*b* of restraining plate 12. Next, as shown in FIG. 3C, press buttons 23*e* are pushed inwardly against the elastic reset force of spring 22 from both sides. Then press buttons 23*e* are inserted through insertion apertures 11*d* in such a way that press buttons 23*e* protrude from the insertion apertures 11*d* of upper cover 11. By means of the above, the construction of connector 10 can be completed.

Connection of a band by means of the band connection fitting of the present preferred embodiment can be made by means of the connection of receiving member 30 and connector 10 which can be assembled according to the above.

Figure 4A:
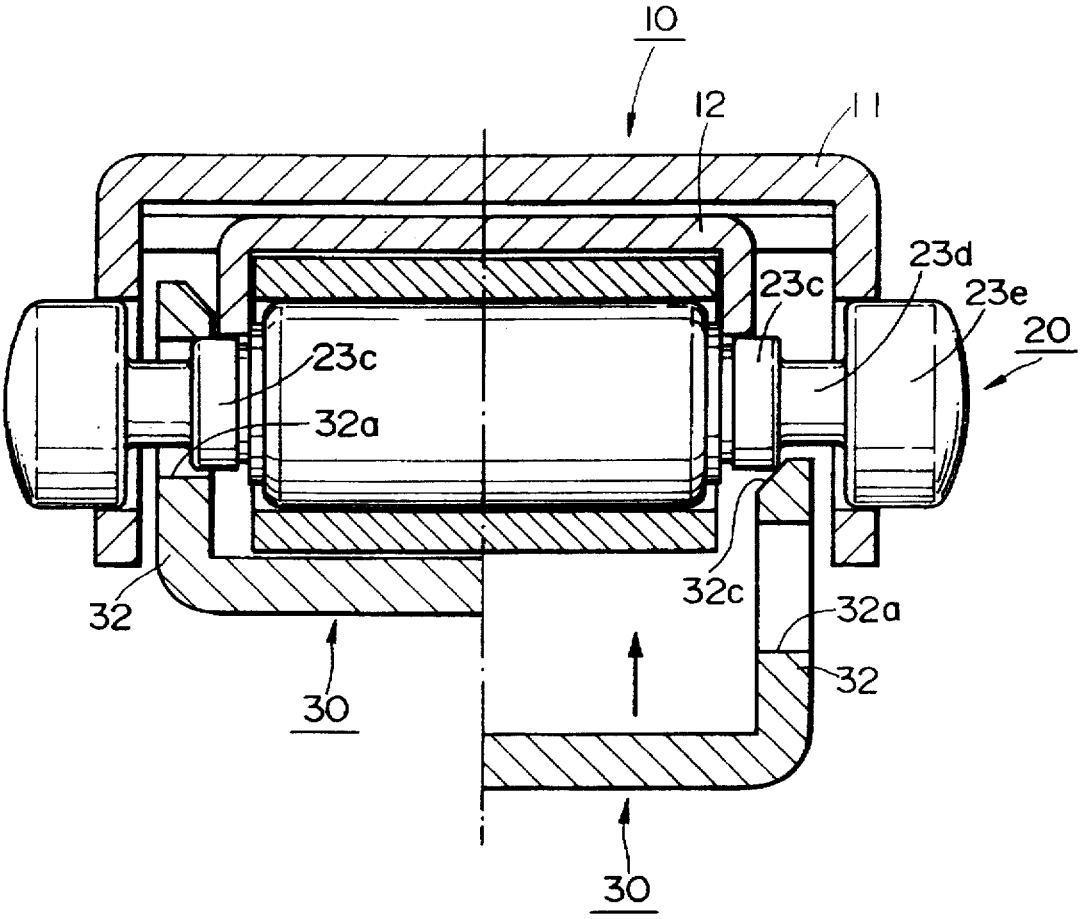
FIG. 4A shows a section view of the manner of connection according to the band connection fitting shown in FIG. 1 as viewed from the direction illustrated by arrow A in FIG. 2.
Figure 4B:
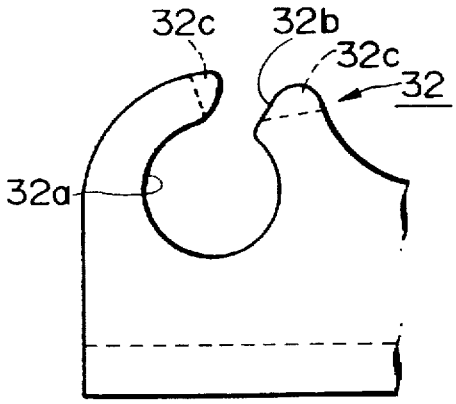
FIG. 4B is a front view of the claws shown in FIG. 2.

That is to say, as shown in FIG. 4A, receiving member 30 is pressed against connector 10. At this time, by means of pressing covering catch 23*c* inward, guided by inclined portions 32*c*, spring bar 20 is compressed. Then, after passing section 23*d* has passed through catch 32*b*, spring bar 20 returns to its normal condition, covering catch 23*c* is received into receiving part 32*a* and is prevented from moving out by catch 32*b*, and the connection of connector 10 and receiving member 30 is achieved. In other words, even without pressing press buttons 23*e*, it is possible to catch and connect receiving member 30 with connector 10 just by pushing them together, realizing a click stop mechanism.

When connector 10 and receiving member 30 are in a connected state, the connected state is maintained by the engagement of catch 32*b* of receiving member 30 with covering catch 23*c* of connector 10.

On the other hand, to release the above-mentioned connection, pushing in press buttons 23*e* from both sides against the elastic reset force of spring 22, forces spring bar 20 into a compressed state, positioning passing sections 23*d* in a position corresponding to catch 32*b*, and the connection is released by the passage of passing sections 23*d* through catch 32*b*.

The present invention is not limited to the above-mentioned embodiment, as substitutes for tri-fold metal type watch bands, it is possible to apply the present invention to watch bands other than tri-fold watch bands, and to bands other than watch bands.

What is claimed is:

1. A connection fitting, comprising:

a connector which has a spring bar provided with press buttons which are pressable toward one another in a direction along a longitudinal direction of the spring bar; and a receiving member which has claws which, in the normal state, catch said press buttons, and release the engagement when said press buttons are pressed toward one another;

wherein each of said press buttons is connected to a passing section and a rod-like covering catch provided sequentially in the inward direction of said spring bar, said covering catch having a larger diameter than said passing section, said connector including an upper cover for covering said passing section;

each of said claws further comprising a receiver part having a size which can receive the covering catch, a catch having a size which allows the passing section to pass through but which catches the covering catch and an inclined portion on a forward edge of the catch for pressing against the covering catch to allow the press buttons to move toward one another, the covering catch of the spring bar being received within the receiving part of the claws and being caught by both a wall portion of the receiving part and the catch in the normal state when the buttons are in their biased position, and thereby the engagement of the connector and the receiving member is achieved, the passing section of the spring bar becoming aligned with the catch and passing through the catch of the claw when the press buttons are pressed toward one another, thereby the engagement of the connector and the receiving member is released.

2. A connection fitting according to claim 1, wherein said connector and said receiving member are connected in a freely foldable manner.

* * * * *